US007366442B2

(12) United States Patent
Ishii et al.

(10) Patent No.: US 7,366,442 B2
(45) Date of Patent: Apr. 29, 2008

(54) FIXING DEVICE

(75) Inventors: Kunihiko Ishii, Osaka (JP); Chisato Hatakeyama, Kawasaki (JP); Hiroshi Ito, Yamatotakada (JP)

(73) Assignee: Kyocera Mita Corporation, Osaka (JP)

( * ) Notice: Subject to any disclaimer, the term of this patent is extended or adjusted under 35 U.S.C. 154(b) by 45 days.

(21) Appl. No.: 11/440,594

(22) Filed: May 25, 2006

(65) Prior Publication Data

US 2007/0025763 A1 Feb. 1, 2007

(30) Foreign Application Priority Data

Jul. 29, 2005 (JP) ..... 2005-221221

(51) Int. Cl.
*G03G 15/16* (2006.01)
*G03G 21/00* (2006.01)
*G03G 15/20* (2006.01)

(52) U.S. Cl. ..... 399/122; 399/124; 399/329

(58) Field of Classification Search ..... 219/216; 399/107, 122, 124, 328, 329
See application file for complete search history.

(56) References Cited

U.S. PATENT DOCUMENTS 6,763,211 B2 * 7/2004 Yokoyama ..... 399/122
7,196,287 B2 * 3/2007 Asai ..... 219/216

FOREIGN PATENT DOCUMENTS

| | | |
|---|---|---|
| JP | 11-327416 | 11/1999 |
| JP | 2001-100597 | 4/2001 |
| JP | 2002-131997 | 5/2002 |
| JP | 2005164691 | 6/2005 |

* cited by examiner

*Primary Examiner*—Hoang Ngo
(74) *Attorney, Agent, or Firm*—The Webb Law Firm

(57) ABSTRACT

A fixing device is provided with a fixing roller and a pressure roller that presses against the fixing roller, and is configured such that an endless belt that is wound around a plurality of belt support rollers presses against the fixing roller and the fixing roller is heated via the endless belt by heat from a heating means mounted inside at least one of the plurality of belt support rollers, wherein the pressure roller is configured to be capable of relatively pressing against and moving apart from the fixing roller and the endless belt is configured to be capable of relatively pressing against and moving apart from the fixing roller.

8 Claims, 4 Drawing Sheets

FIXING DEVICE

CROSS-REFERENCE TO RELATED APPLICATIONS

The present application claims priority upon Japanese Patent Application No. 2005-221221 filed on Jul. 29, 2005, which is herein incorporated by reference.

BACKGROUND

1. Technical Field

The present invention relates to fixing devices incorporated in image forming apparatuses such as copying machines, printers, and facsimile machines, and that are used for fixing a toner image to transfer paper, and more particularly relates to fixing devices provided with a fixing roller and a pressure roller that presses against the fixing roller, and that are configured such that an endless belt that is wound around a plurality of belt support rollers presses against the fixing roller and the fixing roller is heated via the endless belt by heat from a heating means mounted inside at least one of the plurality of belt support rollers.

2. Prior Art

Fixing devices provided with these endless belts aim to shorten warm-up times by directly heating the surface of the fixing roller using the endless belt, and also aim to increase the life of the fixing roller by avoiding increases in partial loads on the fixing roller by enlarging the nip width for heating the fixing roller, and these fixing devices are known conventionally (see JP 2005-164691A for example).

However, in the conventional technique described in the aforementioned patent document, there is no particular mention relating to paper jams of transfer paper in the fixing device, and consequently a long time may be required to clear a paper jam when a paper jam occurs in the fixing device.

That is, not only can a paper jam occur between the fixing roller and the pressure roller in a fixing device provided with an endless belt, but a paper jam may occur extending from between the fixing roller and the pressure roller extending to between the fixing roller and the endless belt, in which case it may be difficult to remove the transfer paper that caused the paper jam and a long time may be required to clear the paper jam.

SUMMARY OF THE INVENTION

The present invention focuses on these conventional problems and it is an object thereof to provide a fixing device provided with an endless belt that heats the fixing roller, that enables paper jams to be cleared relatively simply and within a short time when a paper jam occurs inside the fixing device.

A first feature of the present invention is a fixing device provided with a fixing roller and a pressure roller that presses against the fixing roller, and configured such that an endless belt that is wound around a plurality of belt support rollers presses against the fixing roller and the fixing roller is heated via the endless belt by heat from a heating means mounted inside at least one of the plurality of belt support rollers, wherein the pressure roller is configured to be capable of relatively pressing against and moving apart from the fixing roller and the endless belt is configured to be capable of relatively pressing against and moving apart from the fixing roller.

With the first feature of the present invention, in the fixing device provided with a fixing roller and a pressure roller that presses against the fixing roller, and configured such that an endless belt that is wound around a plurality of belt support rollers presses against the fixing roller and the fixing roller is heated via the endless belt by heat from a heating means mounted inside at least one of the plurality of belt support rollers, since the pressure roller is configured to be capable of relatively pressing against and moving apart from the fixing roller and the endless belt is configured to be capable of relatively pressing against and moving apart from the fixing roller, even if a paper jam occurs with transfer paper extending from between the fixing roller and pressure roller to between the fixing roller and the endless belt for example, the transfer paper that caused the paper jam can be removed relatively easily and in a short time by moving apart the pressure roller and the endless belt from the fixing roller.

Accordingly, it is possible to achieve a fixing device capable of processing paper jams simply and in a short time while achieving the merit of using an endless belt for heating the fixing roller, that is, shortening warm-up times and increasing the life of the fixing roller.

A second feature of the present invention is that the plurality of belt support rollers are rotatably held in a single heating unit, and the endless belt presses against and moves apart from the fixing roller by the heating unit relatively moving near and far with respect to the fixing roller.

With the second feature of the present invention, since the plurality of belt support rollers are rotatably held in a single heating unit, inspection operations and maintenance operations for the endless belt wound around the plurality of belt support rollers can be carried out easily.

Also, since the endless belt presses against and moves apart from the fixing roller by the heating unit relatively moving near and far with respect to the fixing roller, the pressing against and moving apart from the fixing roller by the endless belt becomes reliable and it is possible to achieve a desired heating effect and clearing of paper jams.

A third feature of the present invention is that the fixing roller is rotatably held in a fixing unit, the pressure roller is rotatably held in a pressure unit, and the pressure roller presses against and moves apart from the fixing roller by the pressure unit relatively moving near and far with respect to the fixing unit.

With the third feature of the present invention, since the fixing roller is rotatably held in a fixing unit and the pressure roller is rotatably held in a pressure unit, inspection operations and maintenance operations for the fixing roller and the pressure roller can be carried out easily, and since the pressure roller presses against and moves apart from the fixing roller by the pressure unit relatively moving near and far with respect to the fixing unit, the pressing against and moving apart from the fixing roller by the pressure roller becomes reliable and it is possible to achieve a desired fixing effect and clearing of paper jams.

A fourth feature of the present invention is that the fixing unit and the pressure unit as well as the heating unit are configured to be relatively rotatable around a common axis positioned in a lower portion thereof.

With the fourth feature of the present invention, since the fixing unit and the pressure unit, as well as the heating unit, are configured to be relatively rotatable around a common axis, the pressing against and moving apart from the fixing roller by the pressure roller and the endless belt can be carried out swiftly.

Furthermore, when a common axis is provided, a separated state between the units can be achieved easily and the structure of the fixing device can be simplified.

Moreover, since the common axis is positioned in a lower portion of the units, once relative rotation has been caused between the fixing unit with respect to the heating unit and relative rotation between the pressure unit with respect to the heating unit for example, the separated condition after rotation is held and kept stable by gravity.

A fifth feature of the present invention is that a center of gravity of the fixing unit and a center of gravity of the pressure unit are arranged eccentric to the common axis.

With the fifth feature of the present invention, since a center of gravity of the fixing unit and a center of gravity of the pressure unit are arranged eccentric to the common axis, if the units are put into a free condition, the fixing unit and the pressure unit can easily achieve relative rotation with respect to the heating unit due to their own weight.

A sixth feature of the present invention is that a pressing member that holds the pressure unit and the heating unit in a pressed-against state with respect to the fixing unit is provided at an opening cover used to accommodate the aforementioned units.

With the sixth feature of the present invention, since a pressing member that holds the pressure unit and the heating unit in a pressed-against state with respect to the fixing unit is provided at an opening cover used to accommodate the aforementioned units, relative rotation of the pressure unit and the fixing unit with respect to the heating unit can be caused easily by a simple operation of merely opening the opening cover. Furthermore, by closing the opening cover, the units can be put into a pressed-against condition and easily housed within the fixing device.

A seventh feature of the present invention is that an elastic member is provided between the pressure unit and the fixing unit and between the fixing unit and the heating unit.

With the seventh feature of the present invention, since an elastic member is provided between the pressure unit and the fixing unit and between the fixing unit and the heating unit, regardless of the positions in which the pressure unit, the fixing unit, and the heating unit are arranged, relative rotation can be caused reliably using the elastic force of the elastic members.

An eighth feature of the present invention is that a rotation regulating section is provided in a vicinity of the common axis to set an amount of rotational movement of the pressure unit with respect to the heating unit larger than an amount of rotational movement of the fixing unit with respect to the heating unit.

With the eighth feature of the present invention, since a rotation regulating section is provided to set an amount of rotational movement of the pressure unit with respect to the heating unit larger than an amount of rotational movement of the fixing unit with respect to the heating unit, separated sections can be provided reliably between the pressure unit and the fixing unit and between the fixing unit and the heating unit.

Furthermore, since the rotation regulating section is provided in the vicinity of the common axis, structural members of the rotation regulating section can be provided together in a single location, and therefore the device structure can be simplified and miniaturization can be achieved.

PREFERRED EMBODIMENTS

Embodiments of a fixing device according to the present invention are described with reference to the accompanying diagrams.

Figure 1:
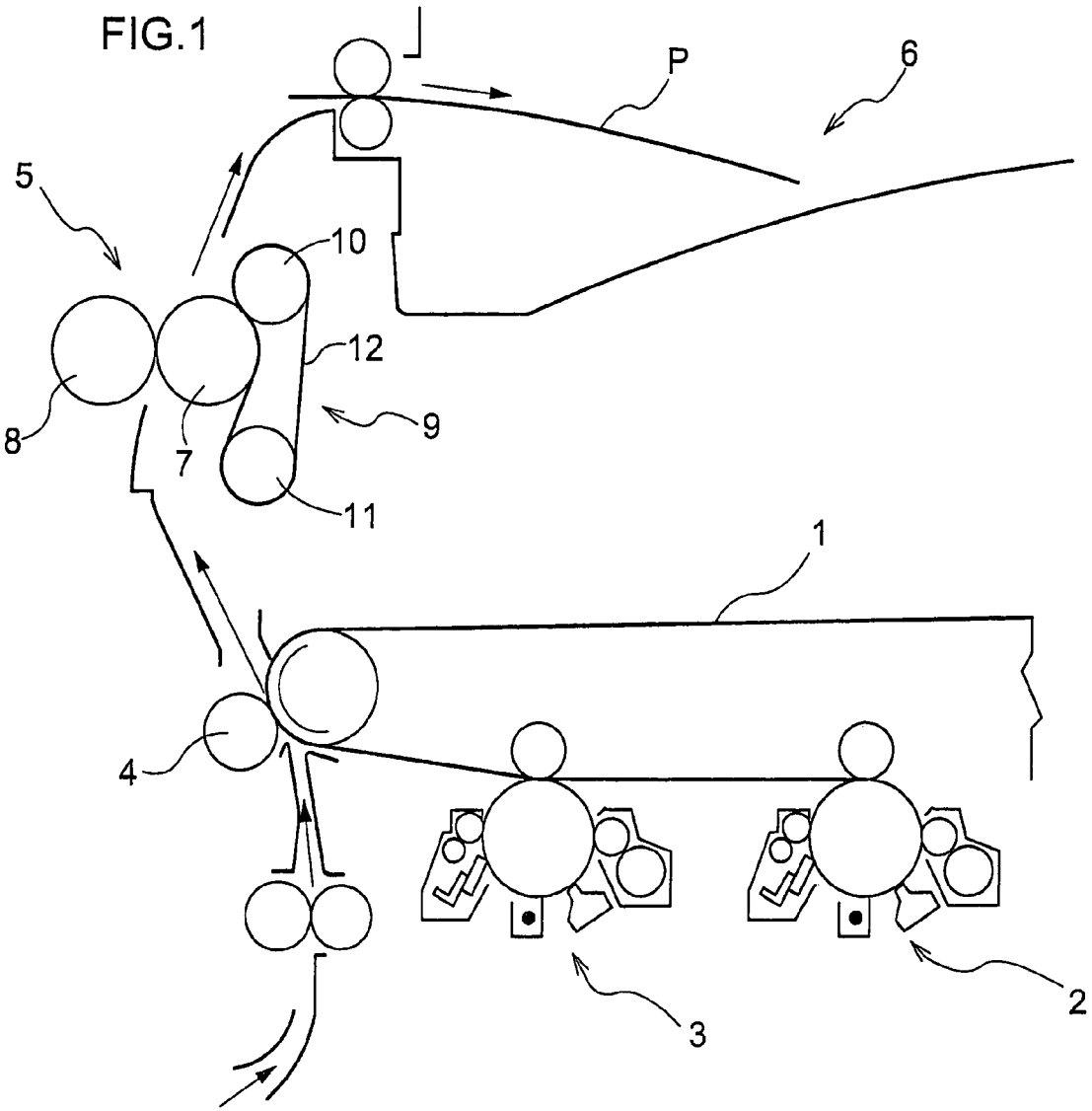
FIG. 1 is a schematic structural view of principal components of a color image forming apparatus.

The fixing device is incorporated in an image forming apparatus such as a copying machine, a printer, or a facsimile machine and is used for fixing a toner image to a transfer paper. For example, in the case of a tandem-type color image forming apparatus, the fixing device is provided with an endless intermediate transfer belt 1 as shown in FIG. 1, and although only two development apparatuses 2 and 3 are shown in the diagram, in fact a total of four development apparatuses for yellow, cyan, magenta, and black are arranged below the intermediate transfer belt 1.

Successively different color toner images are transferred and superimposed onto the intermediate transfer belt 1 by the four development apparatuses, and the toner image on the intermediate transfer belt 1 is transferred to a transfer paper P by applying a reverse bias to a secondary transfer roller 4, after which the toner image is fixed to the transfer paper P by a fixing device 5 and discharged to a paper discharge section 6.

Figure 2:
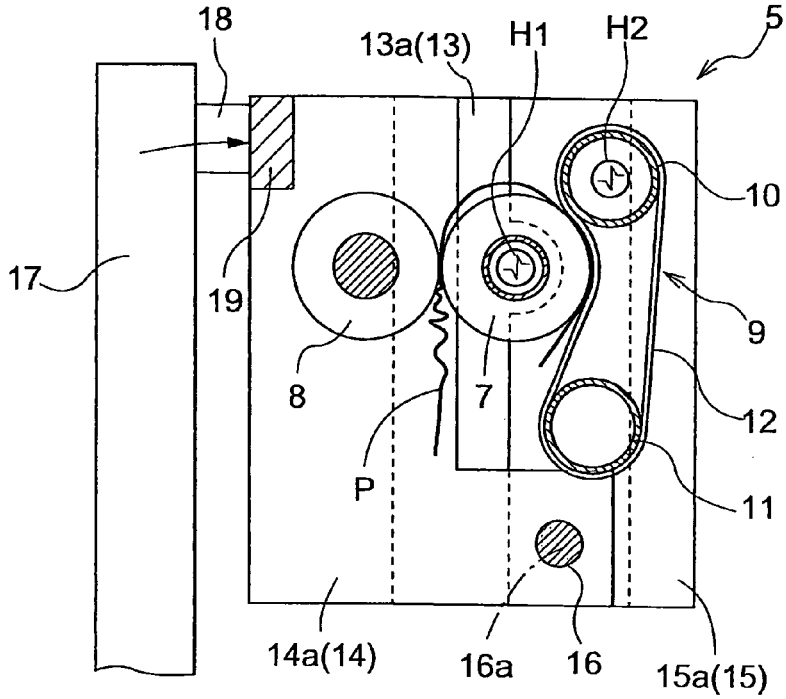
FIG. 2 is a schematic structural view of a fixing device.
Figure 2:
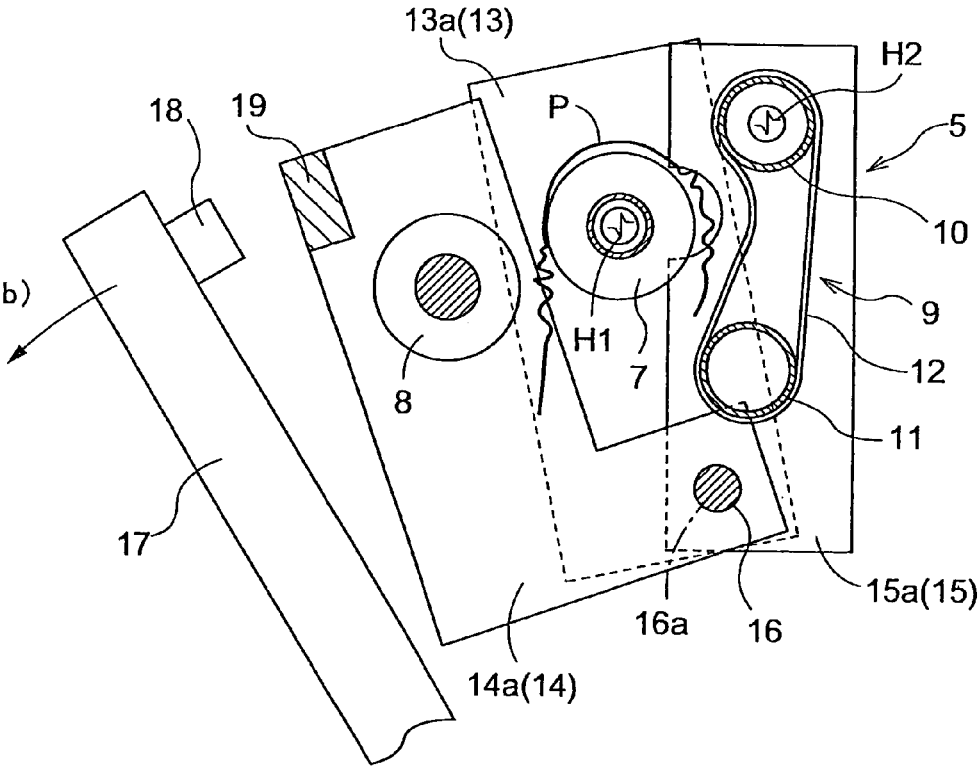

As shown in more detail in FIG. 2, the fixing device 5 is provided with a fixing roller 7 in which a heating means H1 such as a halogen heater is mounted, and a pressure roller 8 that presses against the fixing roller 7, and is further provided with an exterior heating means 9.

The exterior heating means 9 is provided with at least two belt support rollers 10 and 11 and an endless belt 12 that is wound between the belt support rollers 10 and 11, and a heating means H2 such as a halogen heater is mounted inside at least one of the belt support rollers 10 and 11, for instance the upper-positioned belt support roller 10.

The belt support roller 10 inside which the heating means H2 is mounted and the endless belt 12 are pressed against by the fixing roller 7 such that the fixing roller 7 is heated by the heat of the heating means H2 via the endless belt 12.

Both longitudinal direction ends of the fixing roller 7 are rotatably held via bearings not shown in the diagram on a pair of fixing roller holding members 13*a*, which constitute a fixing unit 13, and both longitudinal direction ends of the pressure roller 8 also are rotatably held via bearings not shown in the diagram on a pair of pressure roller holding members 14*a*, which constitute a pressure unit 14.

Further still, the longitudinal direction ends of the two belt support rollers 10 and 11 that constitute the exterior heating means 9 are rotatably held via bearings not shown in the diagram on a pair of support roller holding members 15*a*, which constitute a heating unit 15. That is, the two belt support rollers 10 and 11 are rotatably held in the single heating unit 15.

In regard to the fixing unit 13, which holds the fixing roller 7, the pressure unit 14, which holds the pressure roller 8, and the heating unit 15, which holds the belt support rollers 10 and 11, lower edge vicinities of these units 13, 14, and 15 are attached to a main unit side of the color image forming apparatus via a single shaft 16, and are configured to be relatively rotatable around a common axis 16*a* of the shaft 16.

That is to say, in the example shown in FIG. 2, as is evident by comparing (a) and (b) therein, the heating unit 15 is secured to the main unit side of the color image forming apparatus and the fixing unit 13 and the pressure unit 14 are configured to be relatively rotatable around the common axis 16*a*, and consequently the pressure roller 8 can relatively press against and move apart from the fixing roller 7, and the endless belt 12 wound between the belt support rollers 10 and 11 can relatively press against and move apart from the fixing roller 7.

By using a configuration in which the units 13, 14, and 15 are relatively rotatable around the common axis 16*a*, the pressing against and moving apart from the fixing roller 7 by the pressure roller 8 and the endless belt 12 can be carried out swiftly.

Although not shown in the diagram, it is also effective for the units 13, 14, and 15 to be provided with mutually engageable engaging sections. At this time, for example, when the pressure unit 14 rotates relative to the heating unit 15, the engaging section provided in the pressure unit 14 engages with the engaging section provided in the fixing unit 13, and the pressure unit 14 and the fixing unit 13 operate together to be able to move far and near.

Furthermore, by providing the common axis 16*a*, a separated condition among the units 13, 14, and 15 can be achieved easily. Accordingly, the structure of the fixing device 5 can be simplified. Moreover, since the common axis 16*a* is positioned in a lower portion of the units 13, 14, and 15, once relative rotation has been caused between the fixing unit 13 and the pressure unit 14 as well as the heating unit 15 for example, the separated condition after rotation is held and kept stable by gravity.

An opening cover 17 that opens and closes by a rotation operation centered on the lower portion is provided on the main unit of the color image forming apparatus, a unit pressing member 18 is attached to an upper inner side of the opening cover 17, and a press receiving section 19 is provided at the top of the pressure unit 14 in a position corresponding to the unit pressing member 18.

When the opening cover 17 closes, the unit pressing member 18 presses the press receiving section 19 as shown in FIG. 2(*a*) such that the pressure roller 8 and the endless belt 12 are held in a pressed-against condition with respect to the fixing roller 7.

The fixing unit 13 in FIG. 2 is attached rotatably around the common axis 16*a* positioned eccentric to the lower right side with respect to its own center of gravity (this is at the vicinity of the rotational axis of the fixing roller 7), and the pressure unit 14 is structured in an L-shape and is similarly attached rotatably around the common axis 16*a* positioned eccentric to the lower right side with respect to its own center of gravity (this is at the vicinity of the rotational axis of the pressure roller 8). Thus, as shown in FIG. 2(*b*), when the opening cover 17 opens, the pressure unit 14 and the fixing unit 13 readily rotationally move due to their own weight in a counterclockwise direction around the common axis 16*a*, and the pressure roller 8 and the endless belt 12 go into a separated condition with respect to the fixing roller 7.

In a thus-configured fixing device 5, when a transfer paper P passes between the fixing roller 7 and the pressure roller 8, which are pressed against each other, the toner image is heated and pressed to become fixed to the transfer paper P.

Then, when for some reason the transfer paper P does not separate from the fixing roller 7 and reaches until the endless belt 12 area while stuck to the surface of the fixing roller 7, a paper jam is caused by the paper P becoming sandwiched between the fixing roller 7 and the endless belt 12 as shown in FIG. 2(*a*).

In this case, by simply opening the opening cover 17, the pressure unit 14 and the fixing unit 13 rotationally move in a counterclockwise direction around the common axis 16*a* due to their own weight as shown in FIG. 2(*b*), and since the fixing roller 7 moves away from the endless belt 12 and the pressure roller 8 moves away from the fixing roller 7, transfer paper P that is jammed between the fixing roller 7 and the endless belt 12 as well as between the fixing roller 7 and the pressure roller 8 can be removed to clear the paper jam.

Accordingly, with the present embodiment, when a paper jam occurs in the fixing device 5, relative rotation of the pressure unit 14 and the fixing unit 13 with respect to the heating unit 15 can be caused easily by simply opening the opening cover 17, and therefore the paper jam can be cleared easily. Furthermore, after the paper jam is cleared, by simply closing the opening cover 17, the units 13, 14, and 15 can be put into a pressed-against condition and readily housed within the fixing device 5, and therefore the fixing roller 7, the pressure roller 8, and the endless belt 12 can be returned to an ordinary attached condition.

Figure 3:
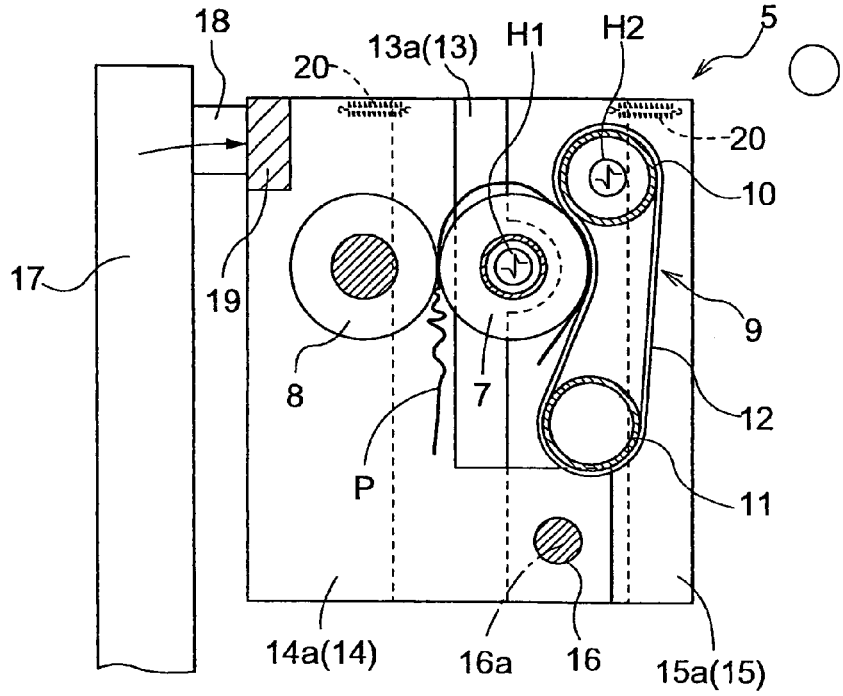
FIG. 3 is a schematic structural view of a fixing device provided with a spring between each unit.
Figure 3:
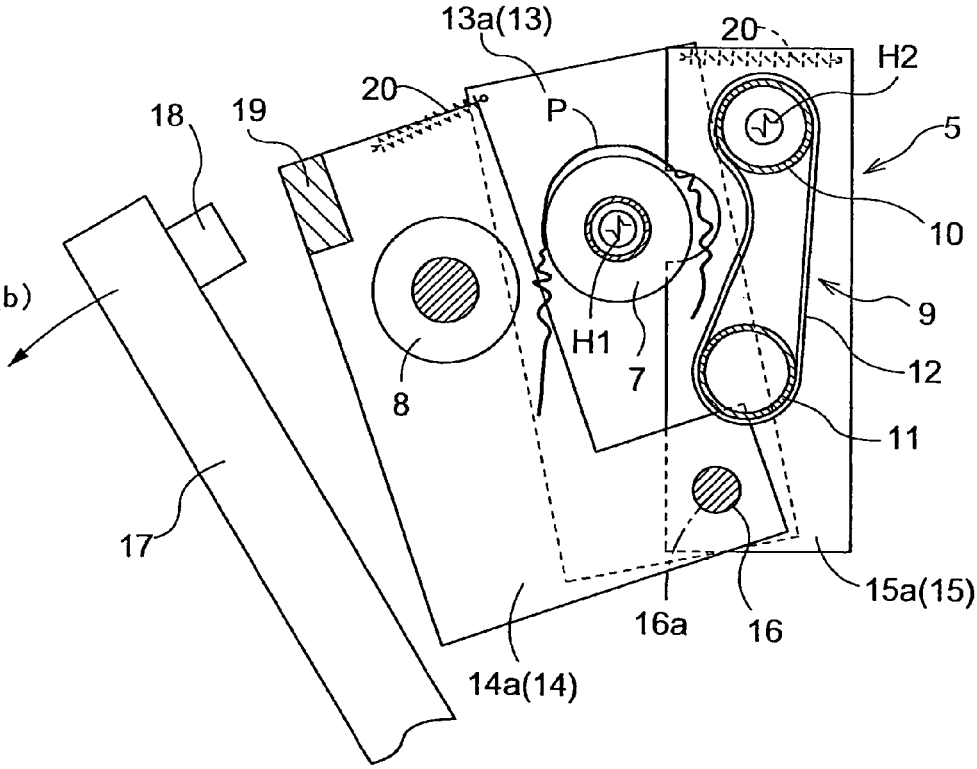

OTHER EMBODIMENTS (1) In the previous embodiment an example was shown in which the fixing unit 13, the pressure unit 14, and the heating unit 15 were configured to be relatively rotatable around the common axis 16*a* positioned in a lower portion thereof, but in this configuration it is also effective that a spring 20 be further provided as an elastic member between the pressure unit 14 and the fixing unit 13 as well as between the fixing unit 13 and the heating unit 15 as shown in FIG. 3 for example.

With this configuration, regardless of the positions in which the pressure unit 14, the fixing unit 13, and the heating unit 15 are arranged (for example, even if the fixing unit 13 and the pressure unit 14 are positioned in such a manner as to be stacked on the heating unit 15), relative rotation can be caused reliably using the force of the springs 20 as shown from the condition in FIG. 3(*a*) to the condition in FIG. 3(*b*).

It should be noted that the position of the common axis 16*a* is arbitrary, and for example can also be configured having the common axis 16*a* positioned upwardly such that the units 13, 14, and 15 are relatively separated by the elastic force of the springs 20.

Figure 4:
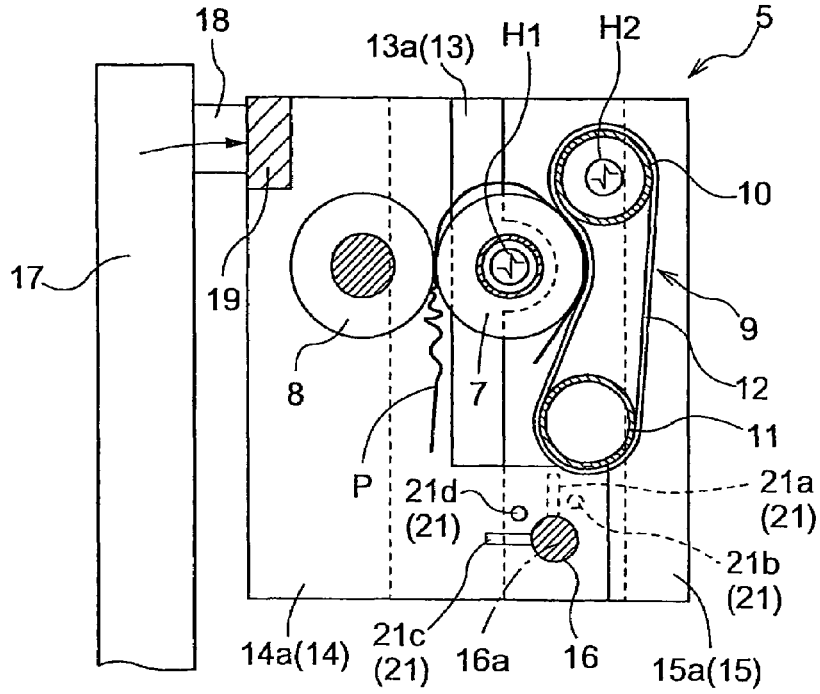
FIG. 4 is a schematic structural view of a fixing device provided with a rotation regulating section at a vicinity of the common axis.
Figure 4:
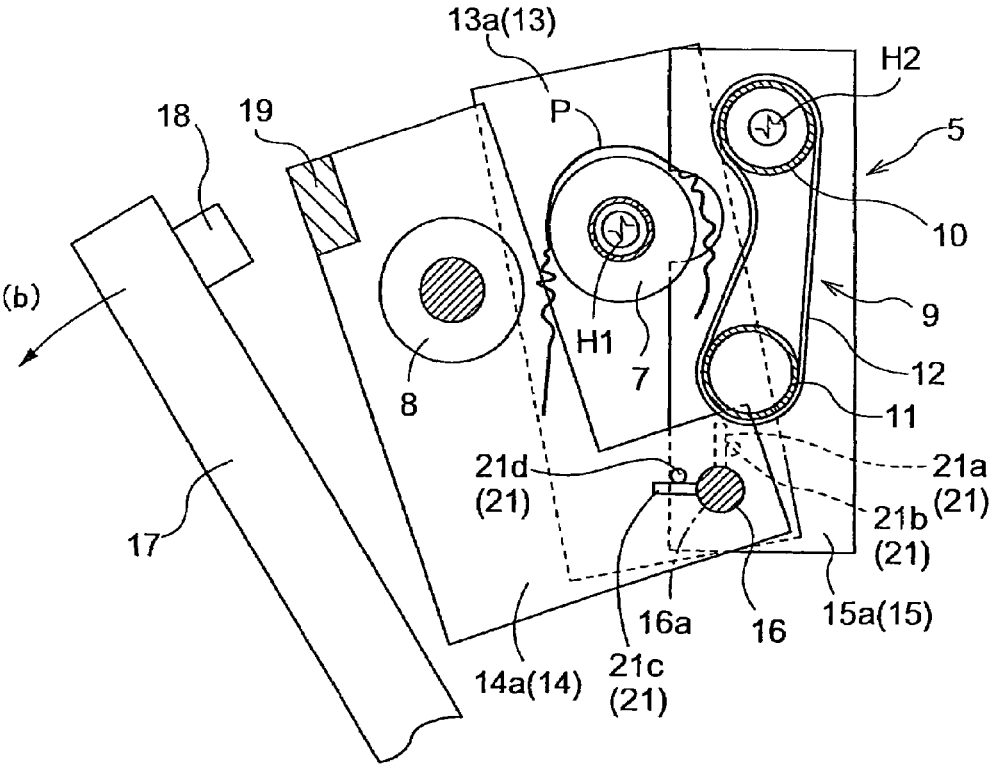

(2) In the previous embodiment, an example was shown in which the fixing unit 13, the pressure unit 14, and the heating unit 15 were configured to be relatively rotatable around the common axis 16*a* positioned in a lower portion thereof, but in this configuration it is also effective that a rotation regulating section 21 is provided in a vicinity of the common axis 16*a* to set the amount of rotational movement of the pressure unit 14 with respect to the heating unit 15 larger than the amount of rotational movement of the fixing unit 13 with respect to the heating unit 15 as shown in FIG. 4 for example.

The rotation regulating section 21 can be configured for example from first contacting sections 21*a* and 21*c* secured to the shaft 16 and second contacting sections 21*b* and 21*d* secured to the fixing unit 13 and the pressure unit 14 respectively. When the opening cover 17 is opened in a fixing device 5 that is provided with the rotation regulating section 21, the pressure unit 14 and the fixing unit 13 commence relative rotation around the common axis 16*a* as shown from the condition in FIG. 4(*a*) to the condition in FIG. 4(*b*). At this time, if the positional relationship of the first contacting section 21*a* and the second contacting section 21*b* and the positional relationship of the first contacting section 21*c* and the second contacting section 21*d* are set appropriately, ultimately the relative rotation will stop at a predetermined position due to contact between the respectively corresponding contacting sections. Thus, separated sections reliably can be provided between the pressure unit 14 and the fixing unit 13 and between the fixing unit 13 and the heating unit 15.

Furthermore, if the rotation regulating section 21 is provided in the vicinity of the common axis 16*a*, the first contacting section 21*a* and the second contacting section 21*b* can be provided together in a single location, and therefore the structure of the fixing device 5 can be simplified and miniaturization can be achieved.

(3) In the previous embodiment, an example was shown in which the fixing unit 13, the pressure unit 14, and the heating unit 15 were configured to be relatively rotatable around the common axis 16*a* positioned in a lower portion thereof, but it is also possible to configure the units 13, 14, and 15 to be relatively slidable such that the pressing against and moving apart between the fixing roller 7, the pressure roller 8, and the endless belt 12 are accomplished by the relative sliding movement thereof.

(4) In the previous embodiment, an example was shown in which the heating means H1 was mounted inside the fixing roller 7, but since the exterior heating means 9 is provided, the present invention also can be realized without mounting the heating means H1 inside the fixing roller 7.

Furthermore, an example was shown in which, of the two belt support rollers 10 and 11 that constitute the exterior heating means 9, the heating means H2 was mounted inside only the one belt support roller 10, but the present invention can also be realized by mounting a similar heating means inside the other belt support roller 11 as well, and moreover, the present invention can also be realized by providing three belt support rollers, winding the endless belt 12 around the three belt support rollers, and mounting the heating means H2 inside at least one of the belt support rollers.

What is claimed is:

1. A fixing device provided with a fixing roller and a pressure roller that presses against the fixing roller, and configured such that an endless belt that is wound around a plurality of belt support rollers presses against the fixing roller and the fixing roller is heated via the endless belt by heat from a heating means mounted inside at least one of the plurality of belt support rollers, wherein the pressure roller is configured to be capable of relatively pressing against and moving apart from the fixing roller and the endless belt is configured to be capable of relatively pressing against and moving apart from the fixing roller.

2. The fixing device according to claim 1, wherein the plurality of belt support rollers are rotatably held in a single heating unit, and the endless belt presses against and moves apart from the fixing roller by the heating unit relatively moving near and far with respect to the fixing roller.

3. The fixing device according to claim 2, wherein the fixing roller is rotatably held in a fixing unit, the pressure roller is rotatably held in a pressure unit, and the pressure roller presses against and moves apart from the fixing roller by the pressure unit relatively moving near and far with respect to the fixing unit.

4. The fixing device according to claim 3, wherein the fixing unit and the pressure unit as well as the heating unit are configured to be relatively rotatable around a common axis positioned in a lower portion thereof.

5. The fixing device according to claim 4, wherein a center of gravity of the fixing unit and a center of gravity of the pressure unit are arranged eccentric to the common axis.

6. The fixing device according to claim 5, wherein a pressing member that holds the pressure unit and the heating unit in a pressed-against state with respect to the fixing unit is provided at an opening cover used to accommodate the aforementioned units.

7. The fixing device according to claim 4, wherein an elastic member is provided between the pressure unit and the fixing unit and between the fixing unit and the heating unit.

8. The fixing device according to claim 4, wherein a rotation regulating section is provided in a vicinity of the common axis to set an amount of rotational movement of the pressure unit with respect to the heating unit larger than an amount of rotational movement of the fixing unit with respect to the heating unit.

* * * * *